US005815125A

United States Patent [19]

Kelly et al.

[11] Patent Number: 5,815,125

[45] Date of Patent: Sep. 29, 1998

[54] SATELLITE DISH COVER

[75] Inventors: David Z. Kelly; Michael G. Ryan, both of Newark, Del.

[73] Assignee: W. L. Gore & Associates, Inc., Newark, Del.

[21] Appl. No.: 795,492

[22] Filed: Feb. 5, 1997

[51] Int. Cl.[6] ..... H01Q 19/12

[52] U.S. Cl. ..... 343/872; 343/840

[58] Field of Search ..... 343/872, 840; 383/74, 75, 4; 52/149, 222; 150/154; 254/222, 223; H01Q 19/12

[56] References Cited

U.S. PATENT DOCUMENTS

| | | | |
|---|---|---|---|
| D. 304,454 | 11/1989 | Serres | D14/231 |
| 810,795 | 1/1906 | McPherson | 254/223 |
| 2,366,299 | 1/1945 | Benschoten | 343/715 |
| 3,351,947 | 11/1967 | Hart | 343/872 |
| 3,388,401 | 6/1968 | Weir | 343/872 |
| 3,599,218 | 8/1971 | Williamson et al. | 343/840 |
| 3,740,755 | 6/1973 | Grenzeback | 343/840 |
| 4,260,003 | 4/1981 | Hendrickson | 150/11 |
| 4,293,862 | 10/1981 | Beavers | 343/872 |
| 4,804,972 | 2/1989 | Schudel | 343/840 |
| 4,946,736 | 8/1990 | Sassa | 428/245 |
| 5,451,972 | 9/1995 | Franklin | 343/840 |
| 5,528,253 | 6/1996 | Franklin | 343/840 |

*Primary Examiner*—Hoanganh T. Le
*Attorney, Agent, or Firm*—Victor M. Genco, Jr.

[57] ABSTRACT

A satellite dish cover, especially suited for protecting a satellite dish assembly of standard construction, includes a sheet of material constructed and arranged for being disposed over the dish and feeder horn of the satellite dish assembly. The sheet has a main body panel which wraps around the dish and feeder horn of the satellite dish assembly and a secondary body panel which extends from the dish to the support of the satellite dish assembly. The main body panel has an outer end portion for receiving the feeder horn therein. A cinching mechanism is affixed to the end portion for cinching and tightening the main body panel about the dish and feeder horn of the satellite dish assembly.

17 Claims, 6 Drawing Sheets

SATELLITE DISH COVER

FIELD OF THE INVENTION

This invention generally relates to satellite dish covers. More particularly, the present invention relates to a satellite dish cover which protects the satellite dish from environmental contamination, and which is electromagnetically transparent.

BACKGROUND OF THE INVENTION

In the art of digital satellite dishes, a commonly constructed dish includes a support, a dish mounted on the support, and a feeder horn mounted on the support in a position where the feeder horn extends generally in front of and perpendicular with respect to the dish. FIG. 1 illustrates a satellite dish in broken lines constructed in the above-described manner. Digital signals are received by the dish from satellites, it being understood that given the digital nature of the signal, if signals are received below a certain threshold, no television reception occurs. Accordingly, a satellite dish produces static-free reception due to the digital nature of the digital signal; there is either reception when little or no interference is present, or no reception when sufficient interference is present.

The feeder horn of the satellite dish is particularly attractive to birds landing thereon. This results in the bird or its excrement interfering with the digital signal reception, thereby preventing the user of the satellite dish from receiving the digital signal, i.e., the user does not receive the signal. Other environmental elements, such as ice and snow, when deposited on the feeder horn, or on the dish itself, can interfere with the digital signal reception as well.

Reference can be made to U.S. Pat. Nos. 5,451,972 to Franklin, 4,946,736 to Sassa, Des. 304,454 to Serres, 4,293,862 to Beavers, 3,388,401 to Weir as representative prior art in this field. Generally, many of these patents, while adapted to conform to the general shape of the satellite dish, do not form-fit thereto for providing a neat, attractive appearance.

In addition, as illustrated in FIG. 1, even a form-fit type cover C does not necessarily eliminate interference between the feeder horn and the dish. As shown, sagging, indicated by reference letter S, of the cover C can occur thereby displacing the cover between the feeder horn and the dish. Such sagging is especially accentuated by snow or ice disposed on top of the cover. Moreover, since there are multiple manufacturers of satellite dishes, each manufacturer producing dishes that vary in shape and size, such discrepancies in the shape and size of the dish can cause the cover C to sag and not form fit in the desired manner.

The foregoing illustrates limitations known to exist in present satellite dish covers. Thus, it is apparent that it would be advantageous to provide a means for overcoming one or more of the limitations set forth above. Accordingly, a suitable alternative is provided including features more fully disclosed hereinafter.

SUMMARY OF THE INVENTION

The present invention advances the art of satellite dish covers known to date. In one aspect of the present invention, a satellite dish cover is especially suited for protecting a satellite dish assembly of the type comprising a support, a dish mounted on the support, and a feeder horn mounted on the support in a position where the feeder horn extends generally in front of the dish. The cover comprises a sheet of material constructed and arranged for being disposed over the dish and feeder horn of the satellite dish assembly. The sheet has a main body panel which wraps around the dish and feeder horn of the satellite dish assembly and a secondary body panel which extends from the dish to the support of the satellite dish assembly. The main body panel has an outer end portion for receiving the feeder horn therein. A cinching mechanism is affixed to the end portion for cinching the main body panel about the dish and feeder horn of the satellite dish assembly.

More particularly, in the shown embodiment, the cinching mechanism comprises a patch of hook and loop fastener material affixed to the outer surface of the end portion of the main body panel, and a first strap secured to the outer surface of the end portion adjacent the patch. The first strap has a piece of hook and loop fastener material provided thereon which mates with the patch of hook and loop fastener material secured to the outer end portion for cinching the main body panel about the dish and feeder horn of the satellite dish assembly. The cinching mechanism further comprises a second strap secured to the outer surface of the end portion adjacent the patch in a position opposite the first strap. The second strap has a piece of hook and loop fastener material provided thereon which mates with a piece of hook and loop fastener material provided on the first strap for further cinching the main body panel about the dish and feeder horn of the satellite dish assembly.

Accordingly, a purpose of the present invention is that of a satellite dish cover which is formfitting with a satellite dish of the type having a dish, a feeder horn, and a support.

Another purpose of the present invention is that of a satellite dish cover which is capable of being cinched about the satellite dish and feeder horn for substantially eliminating any interference caused by the cover between the feeder horn and the dish.

Yet another purpose of the present invention is that of a satellite dish cover that can accommodate satellite dishes of varying shapes and sizes.

Another purpose of the present invention is that of a satellite dish cover which is electromagnetically transparent so that digital signals can be received by the satellite dish even when the cover is disposed over the dish.

A further purpose of the present invention is that of a satellite dish cover which enhances the appearance of the satellite dish.

Yet another purpose of the present invention is that of a satellite dish cover which is fabricated from rugged, durable material that is lightweight and resistant to sunlight, ozone, temperature extremes, wind, rain, and snow.

Yet a further object of the present invention is that of a satellite dish cover which is easy to dispose over the satellite dish.

Another object of the present invention is that of a satellite dish cover which is easy to manufacture and requires less material than prior art dish covers.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 2:
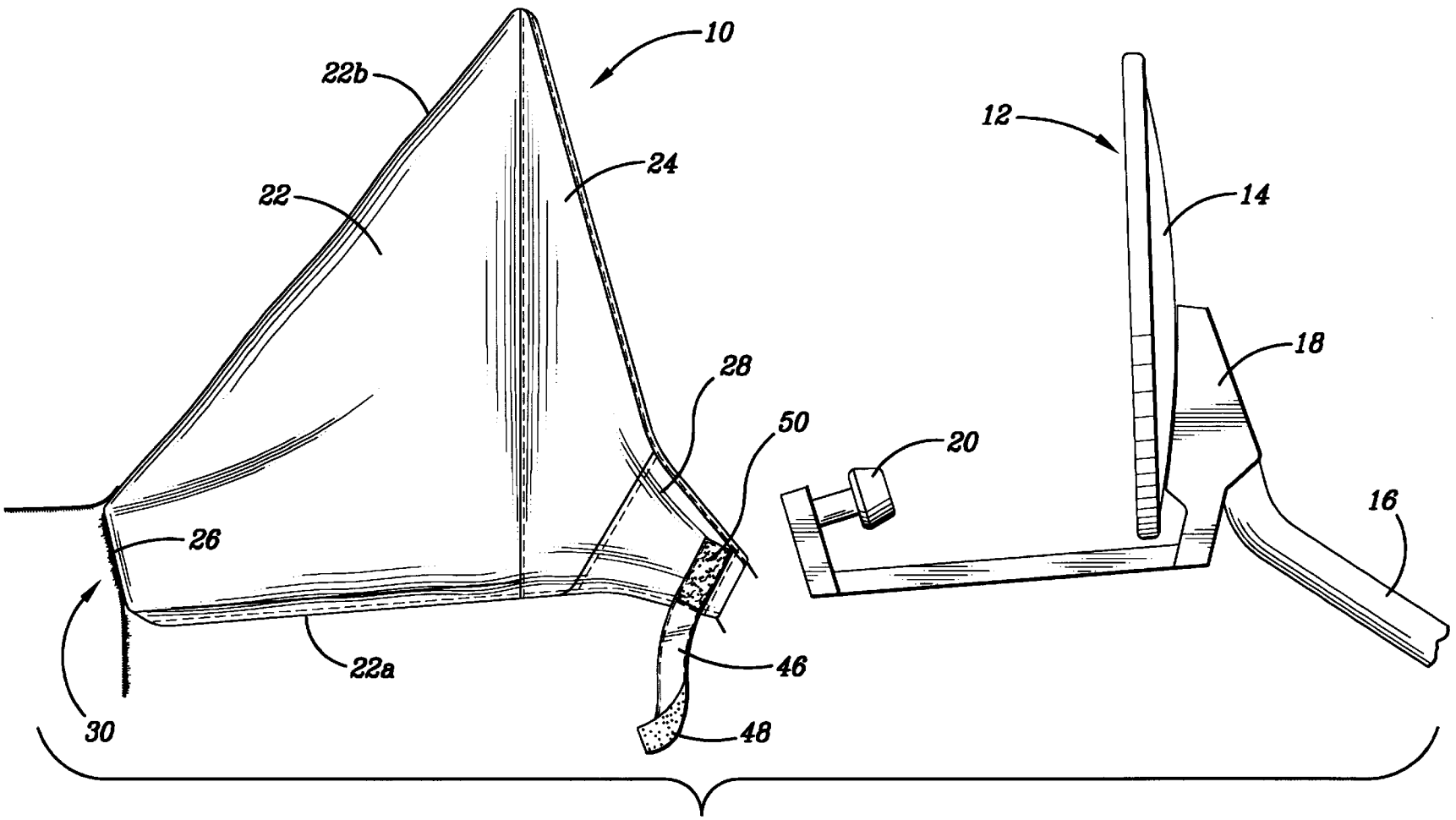
FIG. 2 is a side elevational view of a satellite dish and a satellite dish cover of the present invention spaced therefrom.

Referring now to the drawings, wherein similar reference characters designate corresponding parts throughout the several views, a satellite dish cover of the present invention is generally illustrated at 10 in FIG. 2. As shown, the satellite dish cover 10 is constructed for being disposed over and covering a digital satellite dish, generally indicated at 12. The satellite dish 12 includes a parabolic dish 14 of well-known construction, the dish 14 being mounted on and supported by an elongate, cylindrical support 16. Mounting the satellite dish 12 on the support 16 is a support member 18, which, in addition to supporting the dish, also supports a feeder horn 20, which extends in front of and is generally perpendicular to the dish. The arrangement of the satellite dish 12 illustrated in FIG. 2 is well-known in the art of digital satellite systems.

As mentioned above, environmental debris, and other unwanted matter, such as snow, ice, and the like, can interfere with the digital signal being received by the satellite dish 12. Given the digital nature of the satellite system, it is particularly desirable to eliminate any risk of debris which may interfere with the signal being received by the dish 12. For example, birds resting on the feeder horn 20 can interrupt and interfere with the digital signal received by the parabolic dish 14. Thus, the cover 10 of the present invention is constructed so that the satellite dish 12 is well-protected, but also electromagnetically transparent.

Figure 1:
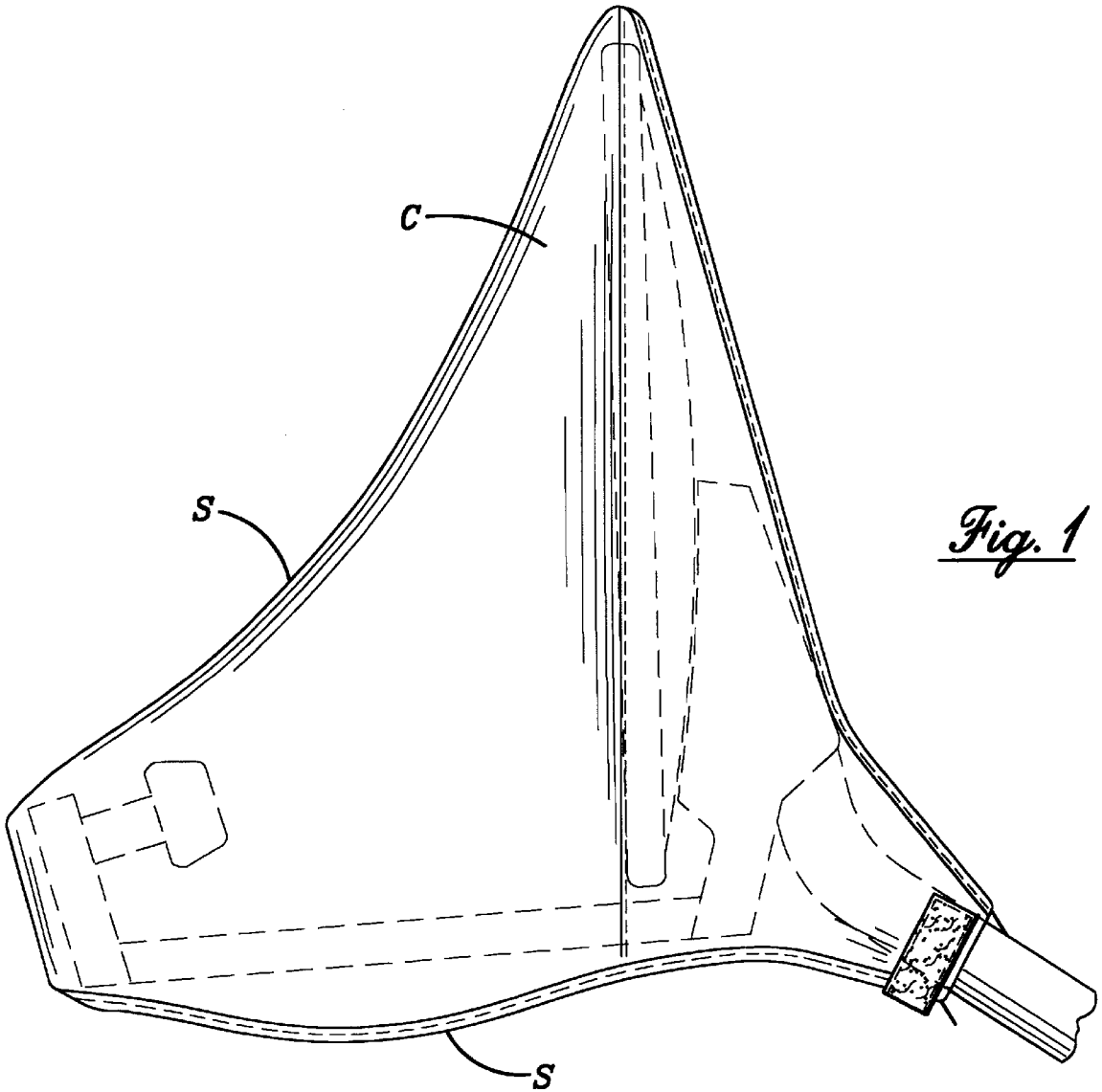
FIG. 1 is a side elevational view of a satellite dish cover of a known embodiment disposed over a satellite dish, the satellite dish being illustrated in broken lines.
Figure 3:
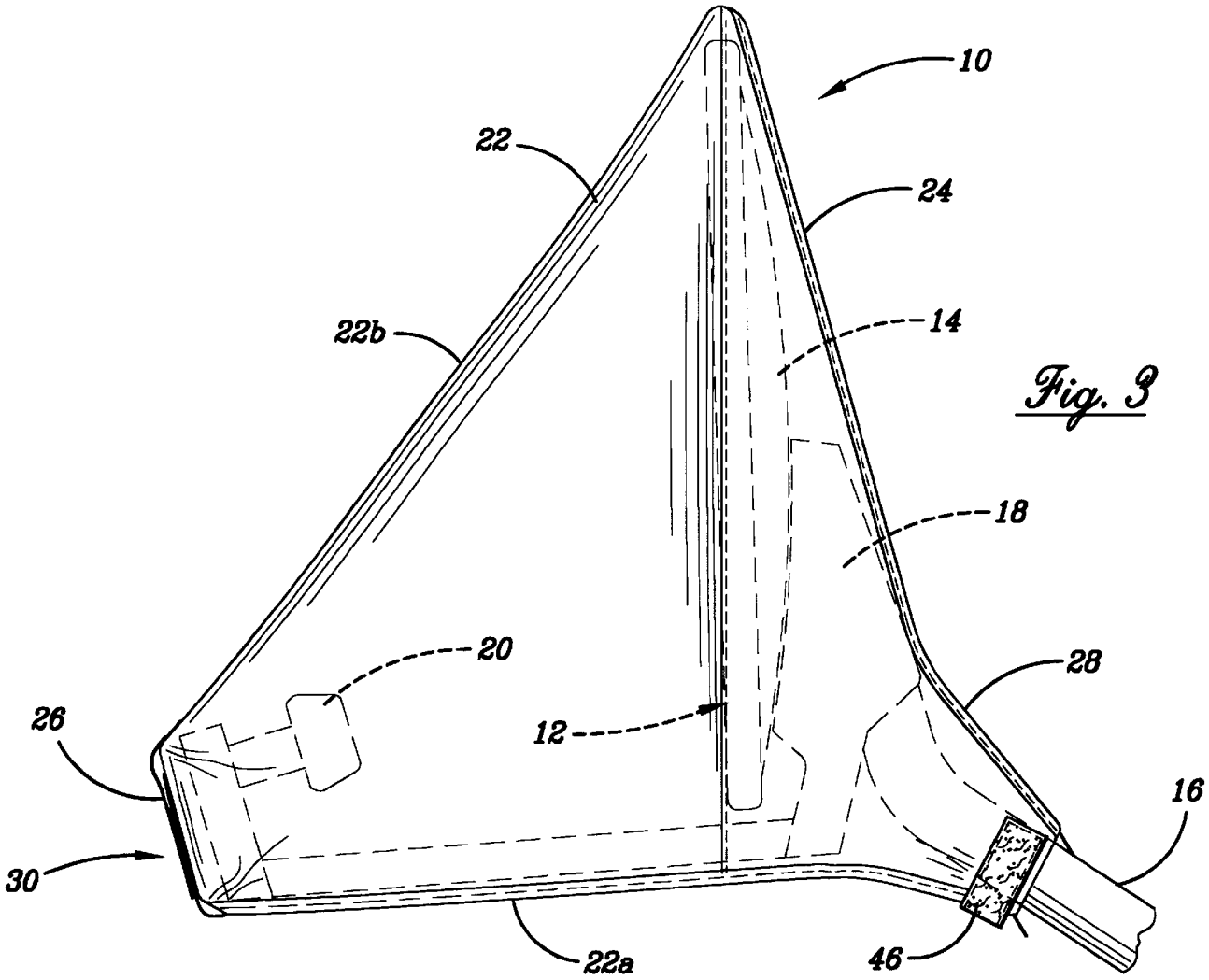
FIG. 3 is a side elevational view of the satellite dish cover of the present invention disposed over the satellite dish, the dish being illustrated in broken lines.

Referring to FIGS. 2 and 3, the cover 10, which is constructed similarly to cover C depicted in FIG. 1, comprises a flexible sheet of material constructed and arranged for being disposed over the parabolic dish 14 and feeder horn 20 of the satellite dish 12. The sheet includes a main body panel 22 and a secondary body panel 24 which is sewn to the main body panel 22. As shown, the main body panel 22 wraps around the dish 14 and the feeder horn 20 of the satellite dish assembly 12, and includes an end portion 26 which receives the feeder horn 20 therein. The secondary body panel 24 extends from the dish 14 to the support 16 in such a manner that it forms a reduced neck portion 28 that wraps around and surrounds the support 16 when disposing the cover 10 over the support 16.

As shown in FIGS. 2 and 3, the cover 10 fits over the satellite dish 12 so that any unwanted elements cannot enter into the interior space defined by the cover 10 and interfere with the operation of the dish 12. More specifically, the main body panel 22 of the cover 10 surrounds the dish 14 and feeder horn 20 when attaching the cover 10 to the satellite dish 12. However, as illustrated in FIG. 1, the main body panel 22, even though it is designed to form fit the dish 14 and feeder horn 20, it still sags. This sagging is especially present where there are minor size differences among satellite dishes, and where snow or ice is disposed on the cover.

In order to eliminate such sagging, a cinching mechanism, generally indicated at 30, is affixed to the end portion 26 for cinching the main body panel 22 about the dish 12 and feeder horn 20 of the satellite dish assembly 12. As illustrated in FIG. 3, the cinching mechanism 30, when employed, substantially eliminates any sagging of the main body panel 22, thereby ensuring a clear path between the feeder horn 20 and the dish 14 for digital signals to travel.

Figure 4:
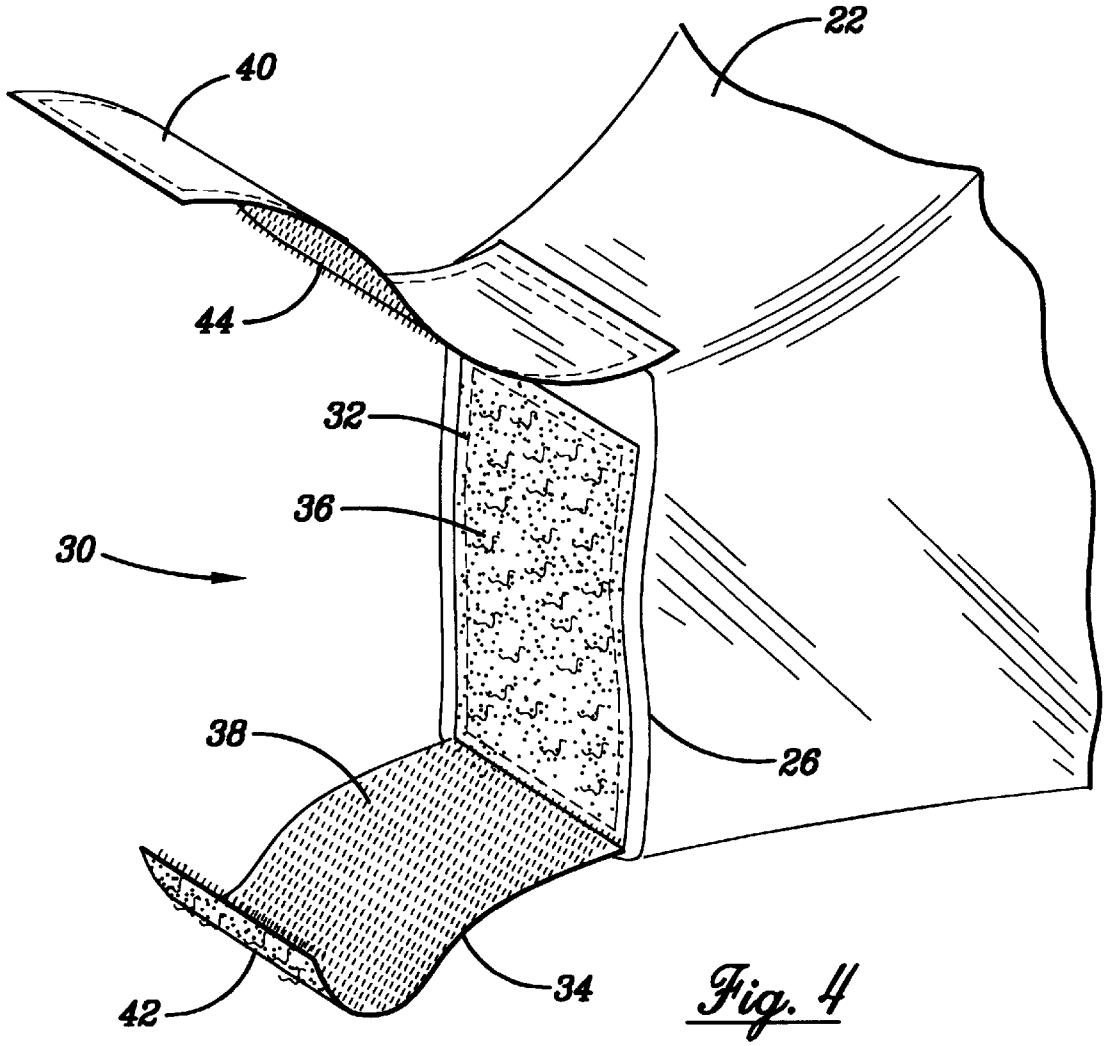
FIG. 4 is an enlarged perspective view of a cinching mechanism of satellite dish cover for cinching the cover tightly about the satellite dish.
Figure 5:
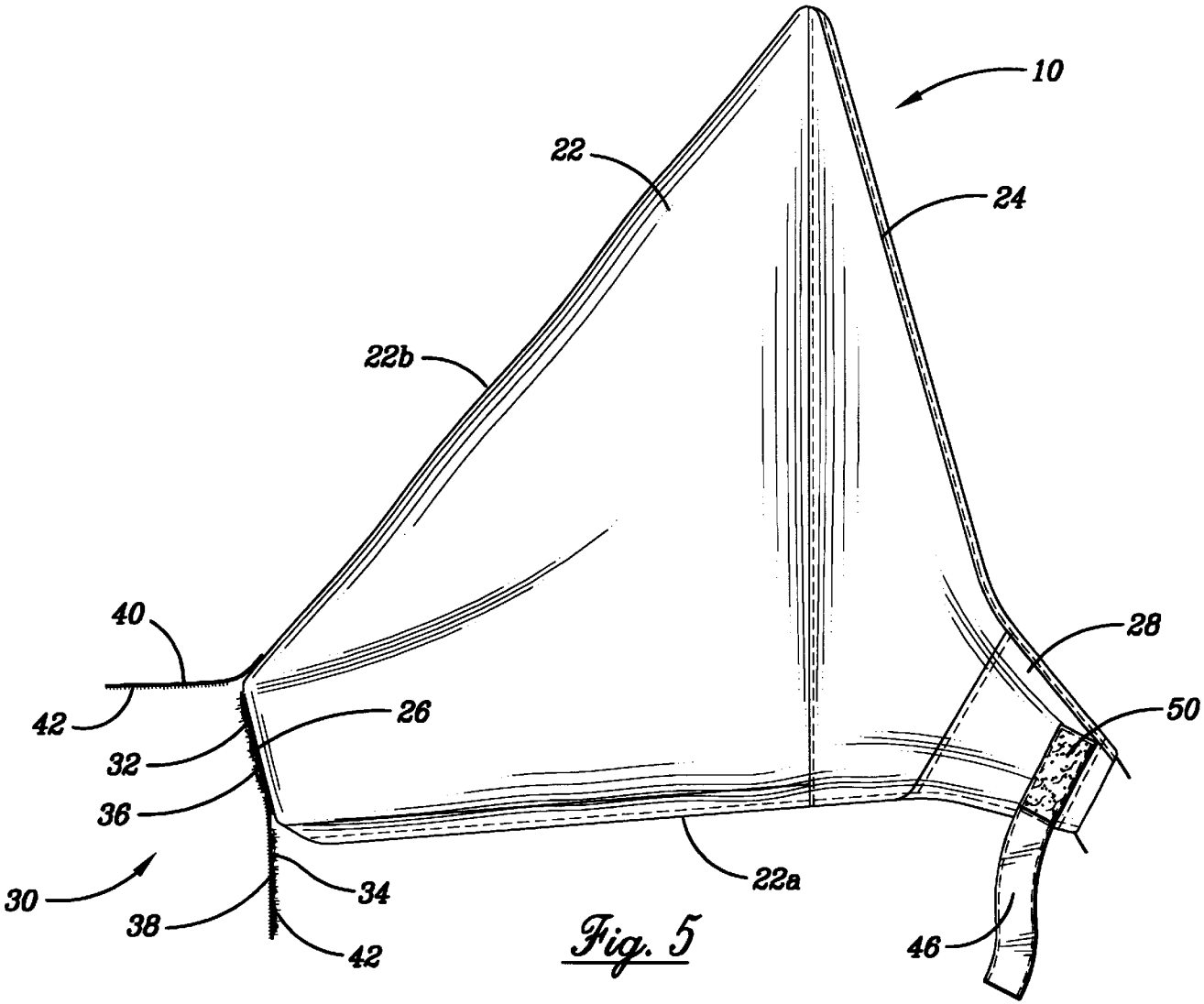
FIG. 5 is a side elevational view of the satellite dish cover prior to the cinching mechanism being cinched.
Figure 6:
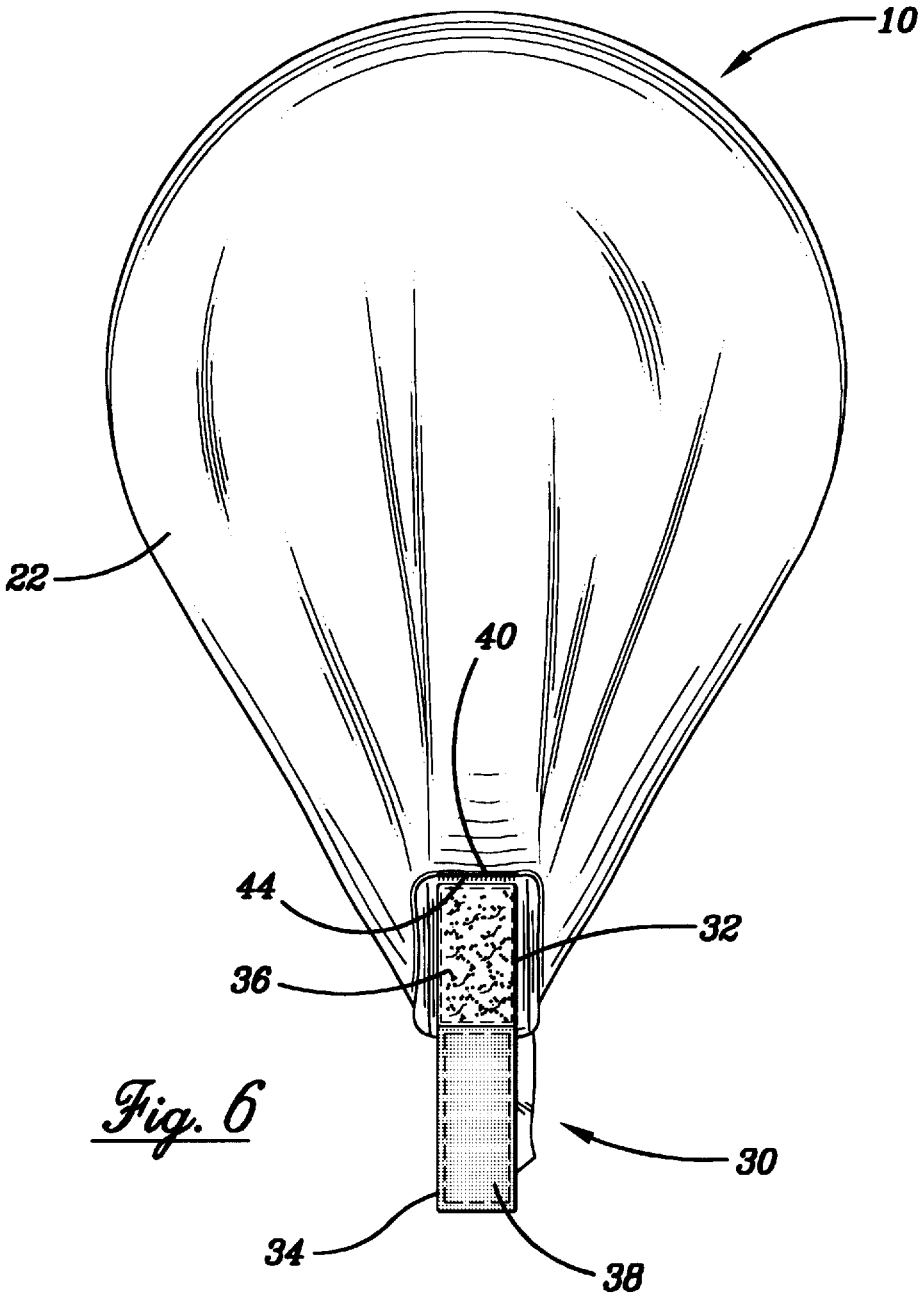
FIG. 6 is a left end elevational view of the satellite dish cover illustrated in FIG. 5.

Turning now to FIGS. 4–6, the cinching mechanism 30, in the shown embodiment, comprises a strip of fabric material 32 sewn to the outer surface of the end portion 26 so that it substantially covers the entire surface of the end portion 26. However, there is a portion of the strip of fabric material 32 that is not sewn to the end portion 26, but extends therefrom to define a first strap 34 of the cinching mechanism 30. It should be noted that the first strap 34 can be fabricated from a separate strip of material that is sewn to the end portion 26 adjacent the strip of fabric material 32. As shown, the strip of fabric material 32 that is sewn on the end portion 26 has a patch of loop fastener material 36 provided on its outer surface. The first strap 34 has an inner surface with a piece of hook fastener material 38 provided thereon. The arrangement is such that the piece of hook fastener material 38 releasably engages the patch of loop fastener material 36 of the strip of material 32 after cinching the first strap 34. This cinching action of the first strap 34 coupled with the engagement of the first strap 34 with the patch 36 tightens the underside **22*a* of the main body panel 22, thereby eliminating the sag of the underside 22*a* of the main body panel 22 that is present in FIG. 1**.

Still referring to FIGS. 4–6, there is a second strap 40, secured to the outer surface of the end portion 26 adjacent the strip of fabric material 32 having the patch of loop fastener material 36. The first strap 34 further includes an outer surface having a piece of loop fastener material 42 provided thereon for mating with a piece of hook fastener material 44 disposed on an inner surface of the second strap 40. Thus, after the first strap 34 is tightly cinched to the patch of loop fastener material 36, the second strap 40 is likewise tightly cinched and engaged so that the piece of hook fastener material 44 provided thereon releasably adheres to piece of loop fastener material 42 of the first strap 34 for tightening the top side **22*b* of the main body panel 22. This eliminates the sag of the top side 22*b* of the main body panel 22 that is present in FIG. 1**.

To uncinch the first and second straps 34, 40, the second strap 40 is initially peeled away from the first strap 34 in the well known manner. Next, the first strap 34 is peeled away from the patch of loop fastener material 36 in identical fashion. At this point, the first and second straps 34, 40 are free from and do not engage the end portion 26 of the main body panel 22. If desired, the cover 10 can be removed from the satellite dish assembly 12 as described in greater detail below.

It should be understood that while a hook and loop fastener material embodying the cinching mechanism 30 is disclosed herein, other fasteners, such as snap-fitting fasteners, buckles, buttons, and the like, can be used as well and still fall within the scope of the present invention.

Referring to FIGS. 3–6, although not illustrated, the secondary body panel 24 preferably has first and second flaps that are separated from one another along adjacent opposite sides so that the flaps can spread outwardly for accommodating the parabolic dish 12 therein when securing the cover 10 to the dish 12. These flaps are releasably attached to one another along mating edges by a zipper, or some other similar device, which is also not shown in the drawings. This construction of the secondary body panel 24 enables the cover 10 to form fit over the satellite dish 12 without having to employ stretchable material which oftentimes is less durable and rugged than non-stretchable material. It should be understood that the main and secondary body panels 22, 24 of the cover 10 can be shaped so as to accommodate satellite dishes having various shapes and sizes without departing from the spirit and scope of the present invention. It is contemplated that the principles of the present invention can be applied to a cover capable of protecting any type of commercially available digital satellite dish.

Referring back to FIGS. 2 and 3, the reduced neck portion 28 has means for releasably securing the reduced neck portion 28 of the flaps over the cylindrical support 16 of the satellite dish assembly 12. More specifically, a strap 46 is attached to one of the flaps in a position and orientation in which the strap 46 wraps around the reduced neck portion 28 of the flaps for ensuring that the reduced neck portion 28 is tightly secured to the support 16. This arrangement prevents any unwanted elements from penetrating or entering into the interior of the cover 10 through an opening (not shown) defined by the reduced neck portion 28.

The strap 46 is preferably stitched to the outer surface of one of the flaps, and has provided on its inner surface a patch of hook fastener material 48 (see FIG. 2). A corresponding patch of loop fastener material 50 is further sewn to the outer surface of the flap of the reduced neck portion 28 in a position generally adjacent the strap 46 so that when wrapping the strap 46 about the reduced neck portion 28, the strap 46 overlies the ends of the zippers and the patch 48 of the strap 46 mates with the patch 50 provided next to the strap 46. The patch 48 of the strap 46 interengages with the patch 50 of the reduced neck portion 28 for releasably securing the strap 46 about the reduced neck portion 28. By merely peeling the strap 46 away from the patch of loop fastener material 50, the strap 46 disengages the patch 50 for allowing the zippers of the cover 10 to be exposed.

Preferably, the sheet of the cover 10 is fabricated from a laminate, such as the laminate disclosed in U.S. Pat. No. 4,946,736, which is incorporated herein by reference. The laminate includes an outer layer formed of porous expanded polytetrafluoroethylene ("ePTFE"). As described in the '736, ePTFE has superior dielectric constant and loss tangent characteristics thus aiding electromagnetic transmission. The outer layer is bonded by means of a thermoplastic polymer to a second layer of ePTFE. The thermoplastic polymer is selected from perfluoroalkoxy tetrafluoroethylene, ethylenetetrafluoroethylene copolymer, copolymer of vinylidene fluoride and chlorotrifluoroethylene, copolymer of vinylidene fluoride and hexafluoropropylene, polychlorotrifluoroethylene, copolymer of hexafluoropropylene and tetrafluoroethylene, polyethylene, fluorinated ethylene propylene copolymer, and polypropylene. The sheet further comprises a backing fabric consisting essentially of woven fibers ePTFE which is attached to the second layer. This backing layer provides strength properties to the laminate, and additional layers of this material may be added where in increase in laminate strength is desired.

It should be observed that as the term is used herein, porous polytetrafluoroethylene (PTFE) shall mean a membrane which may be prepared by any number of known processes, for example, by stretching or drawing processes, by papermaking processes, by processes in which filler materials are incorporated with the PTFE resin and which are subsequently removed to leave a porous structure, or by powder sintering processes. Preferably, the PTFE membrane is porous expanded polytetrafluoroethylene membrane having a microstructure of interconnected nodes and fibrils, as described in U.S. Pat. Nos. 3,953,566; 4,187,390; and 4,110,392, which are incorporated herein by reference, and which fully describe the preferred material and processes for making them. The PTFE membrane may have a thickness in a range from about 3 to 1,000 micrometers, preferably in a range of from about 5 to about 100 micrometers, and a pore volume in a range from about 20 to about 98 percent.

The sheet of laminate material constituting cover 10 is particularly desirable since the laminate is inert to and unaffected by the elements, including sunlight, ozone, temperature extremes, wind, rain, and snow, and are inert, hydrophobic and gas-resistant. The laminate is very thin and strong, has excellent color reflectance and electromagnetic transmission, low dielectric constant, and low loss tangent. The laminate when used as a cover 10 of the present invention reduce maintenance costs, provide lower cost in manufacture, and have low adhesion and excellent release for snow and ice which might form on the surface of the cover 10.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

Having described the invention, what is claimed is:

1. A satellite dish cover for a satellite dish assembly of the type comprising a support, a dish mounted on the support, and a feeder horn mounted on the support in a position where the feeder horn extends generally in front of the dish, said cover comprising:

a sheet of material constructed and arranged for being disposed over the dish and feeder horn of the satellite dish assembly, said sheet having a main body panel which wraps around the dish and feeder horn of the satellite dish assembly and a secondary body panel which extends from the dish to the support of the satellite dish assembly, said main body panel having an outer end portion for receiving the feeder horn therein; and a cinching mechanism affixed to the end portion for cinching and tightening the main body panel about the dish and feeder horn of the satellite dish assembly.

2. A satellite dish cover as set forth in claim 1, said cinching mechanism comprising a patch of hook and loop fastener material affixed to the outer surface of the end portion of the main body panel, and a first strap secured to the outer surface of the end portion adjacent the patch, said strap having a piece of hook and loop fastener material provided thereon which mates with said patch of hook and loop fastener material secured to the outer end portion for cinching the main body panel about the dish and feeder horn of the satellite dish assembly.

3. A satellite dish cover as set forth in claim 2, said cinching mechanism further comprising a second strap, secured to the outer surface of the end portion adjacent said patch in a position opposite the first strap, said second strap having a piece of hook and loop fastener material provided thereon which mates with said patch for further cinching the main body panel.

4. A satellite dish cover as set forth in claim 1, said cinching mechanism comprising a first strap secured to the outer surface of the main body panel adjacent the end portion, and means for releasably securing the first strap to the end portion for cinching the main body panel about the dish and feeder horn of the satellite dish assembly.

5. A satellite dish cover as set forth in claim 4, said releasably securing means comprising a patch of hook and loop fastener material affixed to the outer surface of the end portion of the main body panel, and a piece of hook and loop fastener material provided on the first strap which mates with said patch for cinching the main body panel about the dish and feeder horn of the satellite dish assembly.

6. A satellite dish cover as set forth in claim 5, said cinching mechanism further comprising a second strap secured to the outer surface of the main body panel adjacent the end portion in a position opposite the first strap, said second strap having a piece of hook and loop fastener material provided thereon which mates with a piece of hook and loop fastener material provided on the first strap for further cinching the main body panel about the dish and feeder horn of the satellite dish assembly.

7. A satellite dish cover as set forth in claim 1, said cinching mechanism comprising a patch of hook and loop fastener material affixed to the outer surface of the end portion of the main body panel, and a strap secured to the outer surface of the end portion adjacent the patch, said strap having a piece of hook and loop fastener material provided thereon which mates with said patch of hook and loop fastener material secured to the outer end portion for cinching the main body panel about the dish and feeder horn of the satellite dish assembly.

8. A satellite dish cover as set forth in claim 1, said secondary body panel having reduced neck portion which surrounds the support when attaching the cover to the satellite dish assembly.

9. A satellite dish cover as set forth in claim 8 further comprising means for releasably securing the reduced neck portion of the sheet over the support.

10. A satellite dish cover as set forth in claim 9, said securing means of the reduced neck portion comprising a strap which wraps around the reduced neck portion of the sheet.

11. A satellite dish cover as set forth in claim 10, said strap being secured to the outer surface of the reduced neck portion.

12. A satellite dish cover as set forth in claim 11, said strap having a patch of hook and loop fastener material provided thereon which mates with a patch of hook and loop fastener material secured to the reduced neck portion adjacent the strap for securing the strap about said reduced neck portion.

13. A satellite dish cover as set forth in claim 1, said sheet having a first layer of porous expanded polytetrafluoroethylene ("ePTFE").

14. A satellite dish cover as set forth in claim 13, said sheet further comprising a second layer of ePTFE.

15. A satellite dish cover as set forth in claim 14, said first and second layers being adhered to one another by a thermoplastic polymer.

16. A satellite dish cover as set forth in claim 15, said thermoplastic polymer being selected from perfluoroalkoxy tetrafluoroethylene, ethylenetetrafluoroethylene copolymer, copolymer of vinylidene fluoride and chlorotrifluoroethylene, copolymer of vinylidene fluoride and hexafluoropropylene, polychlorotrifluoroethylene, copolymer of hexafluoropropylene and tetrafluoroethylene, polyethylene, fluorinated ethylene propylene copolymer, and polypropylene.

17. A satellite dish cover as set forth in claim 16, said sheet further comprising a backing fabric consisting essentially of woven fibers ePTFE.

* * * * *